US009821192B2

(12) United States Patent
Rullo et al.

(10) Patent No.: US 9,821,192 B2
(45) Date of Patent: Nov. 21, 2017

(54) GAFF FOR TREE AND POLE CLIMBER

(71) Applicant: Buckingham Manufacturing Co., Inc., Binghamton, NY (US)

(72) Inventors: James J. Rullo, Binghamton, NY (US); Deforest Canfield, Oxford, NY (US)

(73) Assignee: Buckingham Manufacturing Co., Inc., Binghamton ( * ) Notice: Subject to any disclaimer, the term of this patent is extended or adjusted under 35 U.S.C. 154(b) by 0 days.

(21) Appl. No.: 14/460,794

(22) Filed: Aug. 15, 2014

(65) Prior Publication Data

US 2016/0045788 A1 Feb. 18, 2016

(51) Int. Cl.
*A63B 27/02* (2006.01)
*A63B 27/04* (2006.01)

(52) U.S. Cl.
CPC ..... *A63B 27/02* (2013.01); *A63B 27/04* (2013.01)

(58) Field of Classification Search
CPC ..... A63B 27/02; A63B 27/04
See application file for complete search history.

(56) References Cited

U.S. PATENT DOCUMENTS 754,016 A * 3/1904 Schmucker ..... 182/221
1,727,237 A * 9/1929 Katz ..... A63B 27/02 182/221
2,016,249 A * 10/1935 Bashlin ..... A63B 27/02 182/221
2,362,517 A * 11/1944 Woodberry ..... 198/389
2,362,518 A * 11/1944 Woodbury ..... A63B 27/02 182/221
6,405,832 B1 * 6/2002 Willis ..... 182/221
7,070,022 B1 * 7/2006 Diggle, III ..... A63B 27/02 182/134

FOREIGN PATENT DOCUMENTS

CA 2415246 A1 * 6/2004
CH 131381 A * 2/1929 ..... A63B 27/02

* cited by examiner

*Primary Examiner* — Alvin Chin-Shue
(74) *Attorney, Agent, or Firm* — Bond Schoeneck & King, PLLC; Frederick Price; George McGuire

(57) ABSTRACT

A climber for use by a user when climbing a tree or pole. The climber includes a stirrup in which the user's foot is to be positioned, a leg iron that extends along the interior side of the user's leg, and a gaff attached to the exterior of the leg iron and that includes a downwardly directed pointed end for biting into the tree or pole and assist the user in climbing or descending the tree or pole. The gaff extends in a plane that is angularly offset relative to the plane in which the stirrup and leg iron extend, thereby keeping the gaff pointed toward the heart of the pole or tree which aids in preventing cutout and promotes ease of climbing.

6 Claims, 2 Drawing Sheets

GAFF FOR TREE AND POLE CLIMBER

REFERENCE TO RELATED APPLICATION

N/A

BACKGROUND

1. Field of Invention

The present invention relates to climbers, and more particularly to an improved gaff position (orientation) used on a climber.

2. Background of Art

Climbers are used by arborists, utility lineman, and others having a need to climb trees or poles. A typical climber includes a stirrup in which the user places his/her foot, a leg iron that extends upwardly from the stirrup and is intended to be positioned on the inside of the user's leg, a climber pad that attaches to the top of the leg iron and straps the climber to the user's leg while affording some padding, and a gaff that extends downwardly from the exterior of the leg iron and is used by the user to bite into the tree or pole and provide support while climbing. The gaff may be permanently affixed to the leg iron or attached via a fastener system such that it can be replaced or reconditioned.

The gaff is an important tool when climbing as it provides the support the user needs while ascending and descending the tree or pole. As climbing is not typically considered to be a comfortable activity, little thought has been given to the ergonomics of the climber and gaff. As such, the leg iron typically runs perpendicular to the foot placement in the stirrup and the gaff is generally extending along a parallel path to the leg iron. While such an arrangement serves the purpose of permitting the user to effectively climb with the aid of the climber and gaff, the user must position the gaff at an angle to adequately penetrate the pole or tree.

OBJECTS AND ADVANTAGES

It is therefore a principal object and advantage of the present invention to provide a climber having improved ergonomics to permit more comfortable setting of the foot and arch while keeping the gaff pointed toward the heart of the pole or tree which aids in preventing cutout and promotes ease of climbing.

It is another object and advantage of the present invention to provide an improved gaff position (orientation) for use on a climber to improve its effectiveness.

Other objects and advantages of the present invention will in part be obvious and in part appear hereinafter.

SUMMARY OF THE INVENTION

In accordance with the foregoing objects and advantages, the present invention provides a climber comprising a stirrup portion in which a user's foot is adapted to be placed along a predetermined axis, a leg iron extending upwardly from the stirrup and along an axis that is transverse to the axis in which the user's foot extends when placed in the stirrup, and a gaff attached to the exterior surface of the leg iron and pointing downwardly and extending along an axis that is offset relative to the axis of the leg iron. In its preferred form, the gaff is offset at an angle of approximately 3° from the axis of the leg iron.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
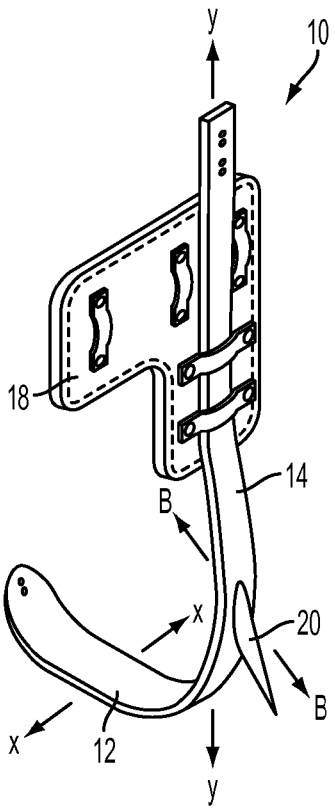
FIG. 1 PRIOR ART
FIG. 1 is a perspective view of a prior art climber in accordance with an embodiment of the present invention.

Referring now to the drawings, wherein like reference numerals refer to like parts throughout, there is seen in the Figures a climber designated generally by reference numeral 10. Climber 10 comprises a stirrup portion/stirrup 12 that is adapted to receive a user's foot thereon, a leg iron 14 extending upwardly from stirrup 12, a climber pad 16 and strap 18 attached to the top of leg iron 14 and adapted to secure climber 10 to the user's leg, and a gaff 20 attached to the exterior surface of leg iron 14 with its pointed end 22 facing downwardly. At least stirrup 12 and leg iron 14 are of unitary construction and extend in a common plane A-A.

Figure 2:
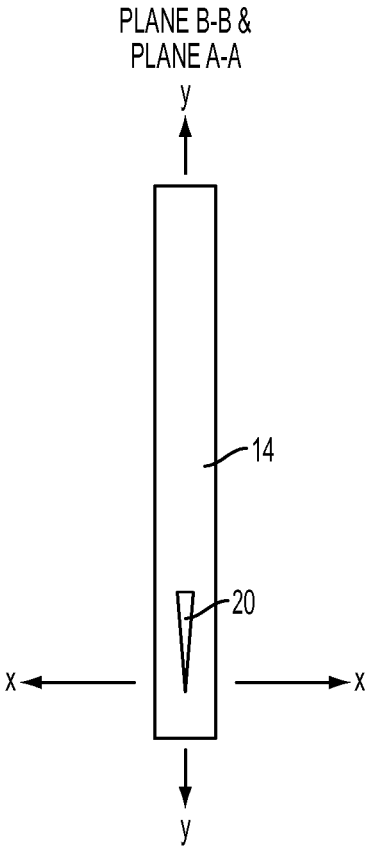
FIG. 2 PRIOR ART
FIG. 2 is a side elevation view of a prior art climber.
Figure 3:
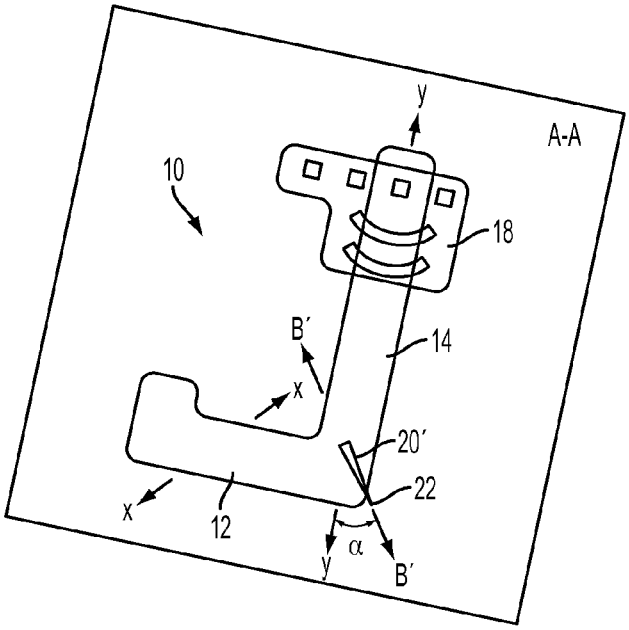
FIG. 3 is a perspective view of a climber in accordance with an embodiment of the present invention.
Figure 4:
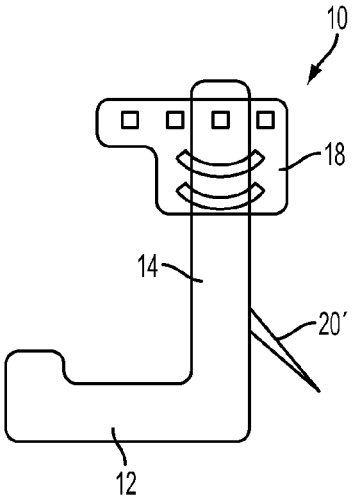
FIG. 4 is a front elevation view of the climber in accordance with an embodiment of the present invention.
Figure 5:
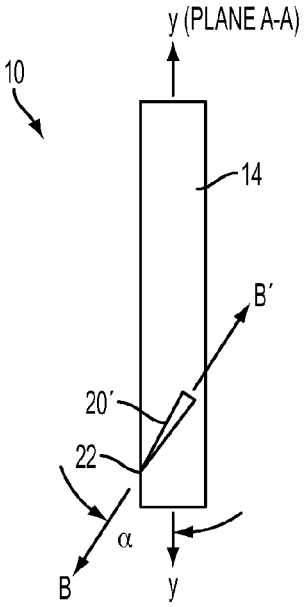
FIG. 5 is a side elevation view of the climber in accordance with an embodiment of the present invention.

In use a user will place his/her foot in stirrup 12 and it will extend essentially along an axis (or in a plane) X-X that is essentially perpendicular to plane A-A. Leg iron 14 will be positioned on the interior of the user's leg and extends along an axis Y-Y that is essentially perpendicular to axis X-X. In the prior art climber of FIGS. 1 and 2, gaff 20 is seen to extend in a plane B-B that is co-planar with plane A-A and is perpendicular to axis X-X. As seen in FIGS. 3-5, gaff 20' extends in a plane/along axis B'-B' that is angularly offset from plane A-A (and axis Y-Y) by $\alpha$ degrees. In its preferred form, $\alpha$ equals approximately $3° \cdot \pm 1°$ By offsetting the angle at which gaff 20' extends relative to the plane in which climber 10 extends (and the axis along which leg iron 14 extends), the user is more ergonomically positioned relative to the pole or tree being ascended or descended in light of the typical user leaning slightly backwardly while climbing at an angle of about 3°. Thus, the angularly offset gaff 20' coincides with the typical angle at which a user leans while ascending or descending a pole or tree using climber 10, thereby providing for a more ergonomic and effective use of gaff 20.

Although the present invention has been described in connection with a preferred embodiment, it should be understood that modifications, alterations, and additions can be made to the invention without departing from the scope of the invention as defined by the claims.

What is claimed is:

1. A climber for donning by a user climbing a tree or pole, comprising:

a stirrup adapted to receive the user's foot thereon, and extending substantially along a direction of a z-axis;

a leg iron extending upwardly from said stirrup, and extending substantially straight along a direction of a central y-axis; the leg iron consisting of a tapered single gaf having a single point and being attached only to said leg iron at substantially said central y-axis and extending downwardly from said leg iron, and extending substantially along a direction bisecting the central y-axis and extending toward a same direction of a x-axis at a juncture of said y-axis and said z-axis;

wherein, said gaff extends in a first plane;

wherein said stirrup and said leg iron extend in a common second plane; and wherein said first plane is angularly offset from said second plane by a predetermined angle.

2. The climber according to claim 1, wherein said predetermined angle is in the range of 2 to 4 degrees.

3. The climber according to claim 1, wherein said predetermined angle is 3 degrees.

4. The climber according to claim 1, further comprising a climber pad attached to said leg iron.

5. The climber according to claim 1 wherein said gaff is permanently attached to said leg iron.

6. The climber according to claim 1, wherein said gaff is removably attached to said leg iron.

* * * * *